US008256043B2

(12) United States Patent
Fromme-Ruthmann

(10) Patent No.: US 8,256,043 B2
(45) Date of Patent: Sep. 4, 2012

(54) SUPPORT ELEMENT FOR A CUSHION COVER FOR SEATING AND LYING AREAS

(75) Inventor: Margret Fromme-Ruthmann, Schloss Holte-Stukenbrock (DE)

(73) Assignee: Froli Kunststoffwerk Heinrich Fromme oHG, Schloss-Holte-Stukenbrock (DE)

( * ) Notice: Subject to any disclaimer, the term of this patent is extended or adjusted under 35 U.S.C. 154(b) by 277 days.

(21) Appl. No.: 12/594,346

(22) PCT Filed: Dec. 19, 2007

(86) PCT No.: PCT/EP2007/064156

§ 371 (c)(1),
(2), (4) Date: Oct. 2, 2009

(87) PCT Pub. No.: WO2008/119400

PCT Pub. Date: Oct. 9, 2008

(65) Prior Publication Data

US 2010/0058536 A1 Mar. 11, 2010

(30) Foreign Application Priority Data

Apr. 2, 2007 (DE) ..... 20 2007 000 005 U

(51) Int. Cl.
*A47C 23/02* (2006.01)
*A47C 23/04* (2006.01)
*A47C 23/00* (2006.01)
*F16F 1/34* (2006.01)

(52) U.S. Cl. ..... 5/247; 5/231; 5/246; 5/255; 5/254; 5/936; 267/161

(58) Field of Classification Search ..... 5/643, 230, 5/231, 246, 247, 253, 254, 255, 935, 936, 5/697; 267/102, 103, 109, 110, 158, 161, 267/163

See application file for complete search history.

(56) References Cited

U.S. PATENT DOCUMENTS 6,826,791 B2 * 12/2004 Fromme ..... 5/247

FOREIGN PATENT DOCUMENTS

| | | | |
|---|---|---|---|
| DE | 20108407 | U1 | 8/2001 |
| DE | 20318252 | U1 | 12/2004 |
| EP | 1386564 | A | 2/2004 |

OTHER PUBLICATIONS

International Search Report for corresponding International Application PCT/EP2007/064156.

* cited by examiner

*Primary Examiner* — Jonathan Liu
(74) *Attorney, Agent, or Firm* — WRB-IP LLP

(57) ABSTRACT

A support element for a cushion cover for seating and lying areas includes a baseplate that can be fixed to a base, and at least one spring element formed by a plurality of spring arms and extending upward from the baseplate in the direction of the cushion cover.

20 Claims, 11 Drawing Sheets

SUPPORT ELEMENT FOR A CUSHION COVER FOR SEATING AND LYING AREAS

BACKGROUND AND SUMMARY

The invention concerns a support element for a cushion cover for seating and lying areas, preferably for mattresses, comprising a base plate that can be fixed to a base, and at least one spring element formed by a plurality of spring arms and extending upward from the base plate in the direction of the cushion cover, wherein the spring arms each are provided with a substantially U-shaped corrugated spring element on the upper ends thereof, oriented away from the base plate, said corrugated spring element comprising at least two parallel spaced spring legs located on concentric ring tracks and disposed about the central axis of the support element and at least one connecting bar joining the spring legs, one end of the spring leg located on the inner ring track being connected to the corresponding spring arm, and one end of the spring leg located on the outer ring track being connected to the support plate provided for supporting the cushion element.

Various embodiments of such support elements as generically described in the introduction are known from the state of the art.

The support elements usually also are called spring elements and are known as mattress sub-structures in combination with slatted bed frame sub-structures as well as rigid, plate-shaped sub-structures. The described support elements are fixed to these plate-shaped sub-structures or slatted frame sub-structures by way of screw connections or, to provide for easier replacement of the support elements, by way of easily loosening fastening techniques, such as quarter-turn fasteners with the base plate having suitable openings.

The support elements are disposed in regular intervals so that a top view of such a design shows a substantially closed support face comprised of the individual support plates that are part of each support element. In principle such designs have proven themselves in the state of the art. However, it was found that for the purpose of optimizing the comfort of a person lying on a cushion cover, e.g. on a mattress, it may be desirable and necessary to devise the spring properties of individual support elements differently in relation to the weight forces that act on them. Consequently, to obtain even comfort, certain areas of the cushion cover, for example the area of the shoulders or pelvis, may require stiffer spring constants for the spring elements due to the higher forces that must be absorbed there than, for example, in the areas with lower weight forces, such as in the leg or head areas.

To attain this, the state of the art already includes support elements in which the spring effect of the spring elements is modified by using corresponding auxiliary components that are inserted into the support elements. For example, the individual spring arms that are responsible for the spring effect of the spring elements can be limited by using auxiliary components with designs being known in which a plastic component with multiple support arms is disposed between the base plate and sub-structure. The plastic component is rotatable about the perpendicular support element central axis in relation to the support element so that the support arms may rest on the individual spring arms in order to stiffen the overall spring effect of the spring element. The contact overall results in a stiffening of the spring arm cross-section so that the deflection of the spring element comprised of the spring arms overall is lower with identical load.

Depending on the design of the cross-section of the support arms, different rotations of the plastic component result in different reinforcements of the spring arm cross-section.

Furthermore, other designs, generally known as lumbar support adjustments, are customary in which stiffening elements between the base plate and the support plate above it are placed on the inside of the support element, said stiffening elements affecting the spring effect of the original spring element. The structure of such auxiliary elements is largely determined by the design of the basic spring elements of the support element that provide the spring effect so that this will not be described in detail here.

All known support elements with integrated lumbar support adjustment have in common that the layout as well as the possible adjustments of such structures can be improved in regard to ergonomic handling and inexpensive manufacturing.

It is desirable to further develop generic support elements known from the state of the art so that the design structure provides for especially easy handling as well as inexpensive manufacturing of the individual components and their assembly.

ASPECTS OF THE INVENTION

Aspects of the invention facilitate developing such generic support elements.

According to an aspect of the invention that the support plate comprises a ring-shaped frame part that connects the upper ends of the spring legs of the corrugated spring elements and a support disc that is rotatable around the central axis of the support element in the frame part with the support disc having in the outer edge region thereof an adjusting device for limiting the movement of the spring legs of the corrugated spring elements.

Due to this structure according to the invention the newly developed support element now only is comprised of two components, each of which can be produced as a plastic injection molding part. Due to the fact that the support plate comprises the adjusting device for limiting the movement of the spring legs of the corrugated spring elements, it is possible to change the spring effect of individual support elements as required after removing the cushion cover by simply rotating the support disc that is part of the support plate.

Such an adjusting device in the upper area of the support elements is especially effective in as much as the corrugated spring elements that are part of the support element especially influence the overall spring effect of the spring elements comprised of spring arms and corrugated spring elements. Thus the design according to the invention and the resulting limitation of the movement of the spring legs of the corrugated spring elements result in an especially large adjusting range for the spring hardness of the support element.

Special embodiments of the support element according to the invention for a cushion cover for seating and lying areas, preferably mattresses, are also disclosed.

For the design of the adjusting device it was found to be especially advantageous when said adjusting device has a plurality of bars arranged in regular intervals on a concentric ring track and disposed about the central axis of the support element, said bars protruding on the lower flat side facing the base plate and being able to rest against a plurality of spring legs for limiting the movement of the spring legs of the corrugated spring elements when weight is applied to the support elements.

This embodiment results in an integrated adjusting device disposed inside the support element in which no additional space is required when compared to customary spring elements without lumbar support adjustment.

The adjustment possibilities with regard to the spring effect of the support element can be further increased when a plurality of bars that are side by side on the ring track are associated with one spring leg, with the bars having different degrees of stiffness. It can be useful for the bars to have different cross-sections, with the cross-section advantageously being rectangular. If the bars comprise at least one stiffening rib on at least one lateral face that is perpendicular to the ring track, it is possible to achieve different degrees of stiffness of the bars that are part of the adjusting device not only by way of the different cross-sections but also by way of the number of stiffening ribs and their respective sizes. The adjustability with regard to the spring constant of the support element is achieved easily due to the different bar structures in that by rotating the support disc, bars with different degrees of stiffness, i.e. with different cross-sections and/or different bar shapes and different numbers of bars are aligned with the respective spring arms or spring legs, respectively, of the corrugated spring elements so that they overlap. As soon as weight is applied to the support element according to the invention, the spring legs of the corrugated spring element will attempt to change their position. Depending on the degree of stiffness of the bars, this position change will be prevented more or less strongly. The limitation may be so strong that the spring legs of the corrugated spring element cannot move at all. In this case the only spring effect is the elasticity of the spring arms, which results in a support element with especially stiff spring characteristics.

Different degrees of stiffness of the bars can also be achieved by disposing the stiffening ribs on the lateral faces of the bars oriented towards the middle as well as on the opposite lateral faces extending outward. The design structure of the stiffening ribs is determined by the existing space conditions on the support element as well as the required spring constants that can be calculated based on structural adjustments of the stiffening ribs.

In practical applications it has proven especially useful to assign three adjacent bars on the ring track to one spring leg so that it is possible to limit the movement of the spring leg of the corrugated spring elements in three stages when weight is applied to the support elements, which corresponds to an adjustment of the spring constant of the spring element to four different values. The disposition of three bars with different degrees of stiffness results in an adjustment of the support element with regard to its spring effect in four stages in that the rotation position of the support disc, which is considered the stage with the highest degree of spring yield, does not cause any of the bars on the respective ring track to overlap with a spring leg of the respective corrugated spring elements. The spring element responsible for the spring effect of the support element thus has its originally calculated, complete spring path.

Of course it is possible to increase the number of the differently designed bars that are associated with one spring leg. In practical applications it was found, however, that four different degrees of spring stiffness are sufficient for one support element. Furthermore, it is feasible to design the individually constructed bars such that a continuous adjustment of the spring stiffness is possible by designing a bar that is comprised of a plurality of sections. However, such a continuous adjustment is not necessary in most applications and results in higher design and manufacturing costs.

In order to fix the position of the individual bars in connection with the corresponding spring legs of the corrugated spring elements, it might be useful to equip the support disc with a snap-in locking device for fixing different rotation positions in relation to the frame part surrounding the support disc. The snap-in locking device may comprise at least one latch on the frame part or on the support disc, which is used to fix the rotation position of the support disc in a corresponding latch recess that is part of the snap-in locking device on the support disc or can be locked on the frame part. Such a design of a snap-in locking device is inexpensive when it is part of the injection molding process of the support element.

The adjustment can additionally be simplified by the upper side of the support disc that is oriented towards the cushion cover having a display device for the respective rotation position of the support disc in relation to the frame part. For example, by marking the four different degrees of stiffness of the support element with the respective alphanumeric numbers 1 through 4 in connection with the respectively designed snap-in locking device, it is easy to visually check the adjustment of the spring constant.

In order to further increase the user comfort of the mattress sub-structure comprised of the support elements according to the invention, it might further be advantageous to additionally improve the design according to the invention by the support disc having at least one support face that extends upward at an acute angle from the support plane that is defined by the frame part when a cushion cover to which no weight is applied, is placed on the support element.

In addition to the already described advantages this design also provides the support disc with a so-called airlift function. This airlift function is used to provide sufficient back ventilation for the cushion cover. The described design is especially characterized in that the support faces that slant upward and of which there usually is a plurality, provide for a considerably smaller support face when there is no weight on the mattress. This allows for a removal of the body moisture in the short run so that even when the cushion cover is used extensively by a user, there is no sensation of moisture and no odor due to the moisture that is not removed.

Of course, in order to provide for sufficient back ventilation the state of the art provides for solutions that suggest specially formed and separate lift elements comprised of injection molded parts and a spring acting together with them so that the cushion cover is lifted when the weight is removed across the actual support plane defined by the upper side of the support plate. The spring that acts with the lift element is designed such that it provides spring forces due to its spring stiffness that are larger than the weight forces that act on the support element due to the cushion cover weight when no weight is applied.

However, in connection with the design of the support element according to the invention the already known solution for improving the back ventilation of cushion covers, which in principle has proven itself, can be further improved because the so-called airlift function, i.e. the lifting of the cushion cover when no weight is applied, can be fully integrated into the existing elements of the support element according to the invention. Without any additional components the support faces that slant upward cause a point or line-shaped support zone for the cushion cover on the free ends of said upward extending support faces. Thus the mattress rests only on individual points or lines of its bottom side so that the remaining free area can be used for an advantageous back ventilation of the cushion cover. The design of the support element according to the invention that is supplemented in this manner does not require any additional components so that there are no additional costs as compared to the known, customary support elements known in the state of the art.

Furthermore, it is advantageous that there are no assembly costs for the support elements according to the invention, which are equipped with a special lift element for the airlift function, and the supplemented support disc according to the invention.

Especially with regard to the airlift function it was found to be advantageous when the angle of the unloaded support faces ranges between 5 to 40° in relation to the support plane of the cushion cover to which weight is applied. These given angles provide for sufficient back ventilation of the mattress on one hand and on the other hand the lift of the mattress when no weight is applied is small enough due to the support faces extending upward so that any undesired optical appearances are avoided.

Another advantageous further development of the airlift device requires that the support faces substantially have a plate-shaped, triangular outline with one long side of the triangular outline being fixed on the support disc in the outer edge region. This design ensures that the support faces on the side that is oriented away from the outer edge region of the support disc provide individual, point-shaped support zones for the mattress or the cushion cover, respectively, due to the design of the outline.

These point-shaped support zones are optimal for the improved back ventilation of the placed mattresses. Additionally and advantageously the embodiment of the support faces can be such that they have at least one or preferably a plurality of openings. These openings increase the back ventilation when weight is applied to the mattress and additionally support the removal of the body moisture of a person lying on the mattress.

The support faces advantageously are arranged symmetrically on the support disc.

BRIEF DESCRIPTION OF THE DRAWINGS

One exemplary embodiment of the subject of the invention is explained in more detail based on the enclosed drawings. The drawings show different variations of the basic principle of the invention as well as additional advantageous designs in accordance with the sub-claims. The following is shown:

DETAILED DESCRIPTION

Figure 1:
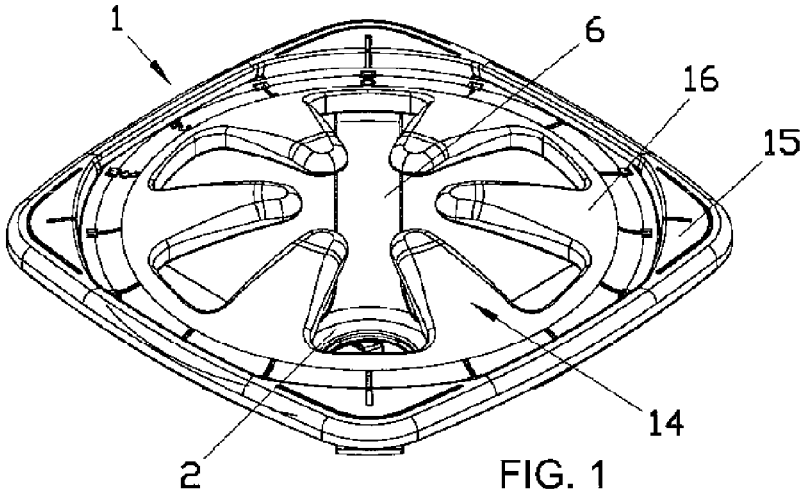
FIG. 1 shows a perspective overall view of the support element according to the invention.

The support element marked with reference number 1 in all Figures comprises a base plate 2 in its lower area to which a fastening device 3, which is not shown in detail, for fixing the support element 1 is arranged on a slatted bed frame or a plate-shaped sub-bed structure.

The fastening device 3 can have different designs and can be a customary screw connection, for example. To ensure that the support elements can be easily replaced, however, it also is possible to use easily loosening fastening techniques such as quarter-turn fasteners that can be loosened without any tools. When using quarter-turn fasteners, it is possible to place a quarter-turn hook with a customary design through the opening 4 in the base plate 2 of the support element 1. Rotating the support element 1 then causes the long-shaped quarter-turn hook to rest against the upper side of the base plate, causing the support element to be fixed on the corresponding sub-structure in the form of a slatted bed frame or a different sub-bed structure. Releasing it requires the reverse order by rotating the support element and then lifting the base plate from the quarter-turn hook.

Based on the base plate 2 the support element 1 has a plurality of spring arms 6 that slant upward. In the present exemplary embodiment four spring arms are distributed symmetrically across the circumference of the support element: The spring arms 6 have corrugated spring elements 7 on their upper end that faces away from the base plate 2, said corrugated spring elements substantially determining the spring properties of the support element.

Each corrugated spring element 7 is comprised of two spring legs 11 and 12 located on concentric ring tracks 9 and 10 disposed about the central axis 8. The upper free end of the spring leg 11 is connected to the end of the spring arm 6, its lower free end is connected to the lower end of the spring leg 12 by means of a connecting bar 13. The upper free end of the spring leg 12 is connected to a frame part 15 that is part of a support plate 14.

Figure 7:
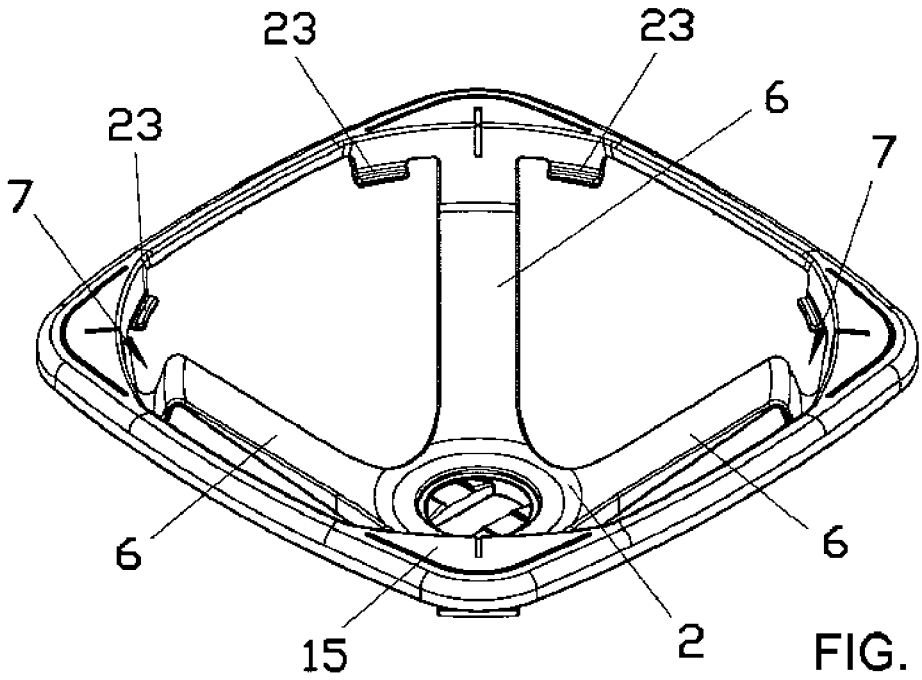
FIG. 7 shows a perspective view of the support element according to the invention without mounted support disc.
Figure 8:
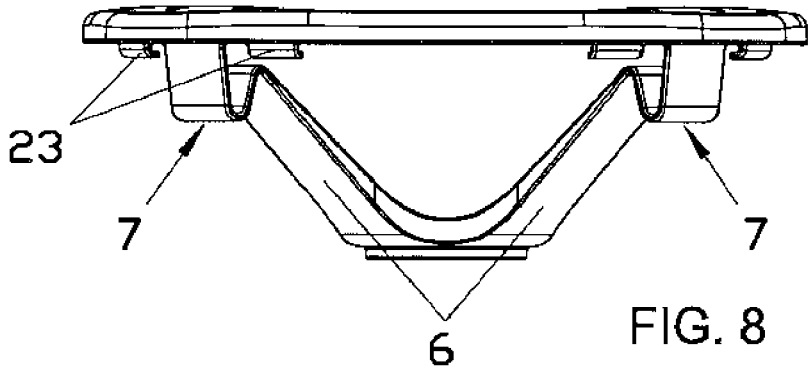
FIG. 8 shows a lateral view of the support element without support disc according to FIG. 7.
Figure 9:
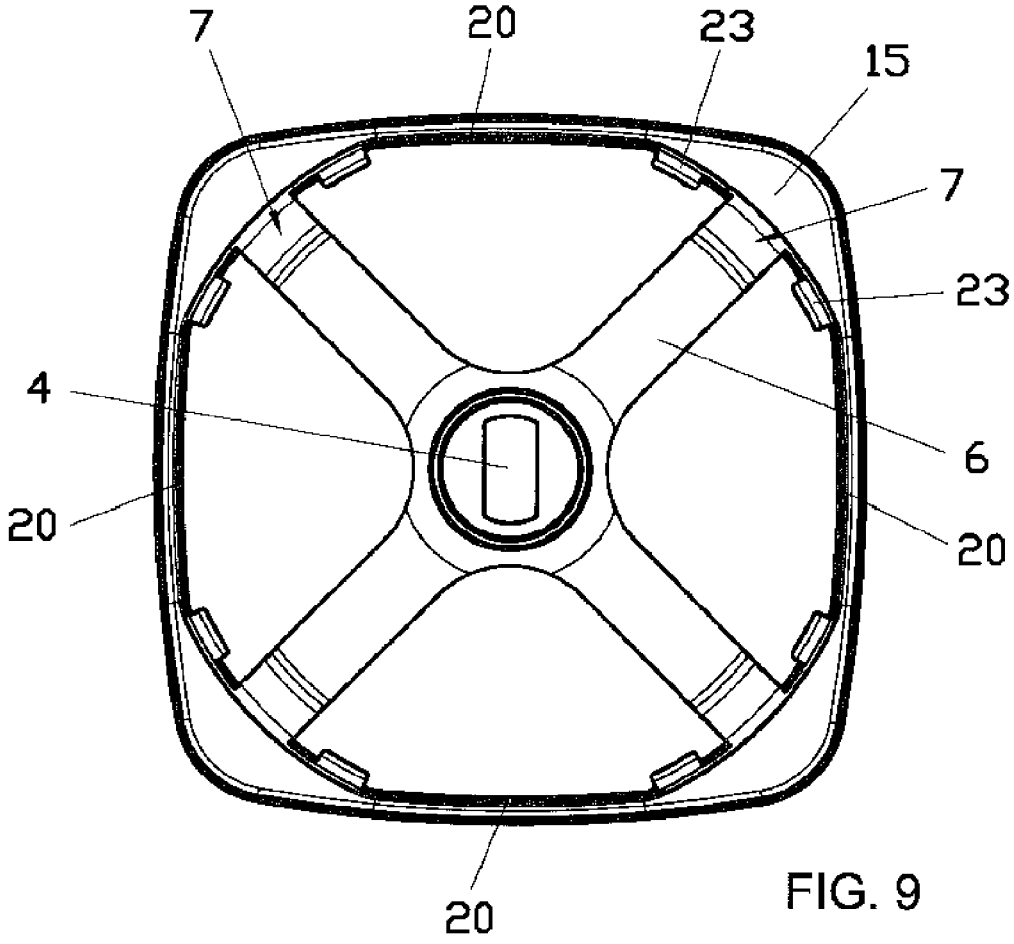
FIG. 9 shows a top view of the support element without support disc according to FIGS. 7 and 8.
Figure 10:
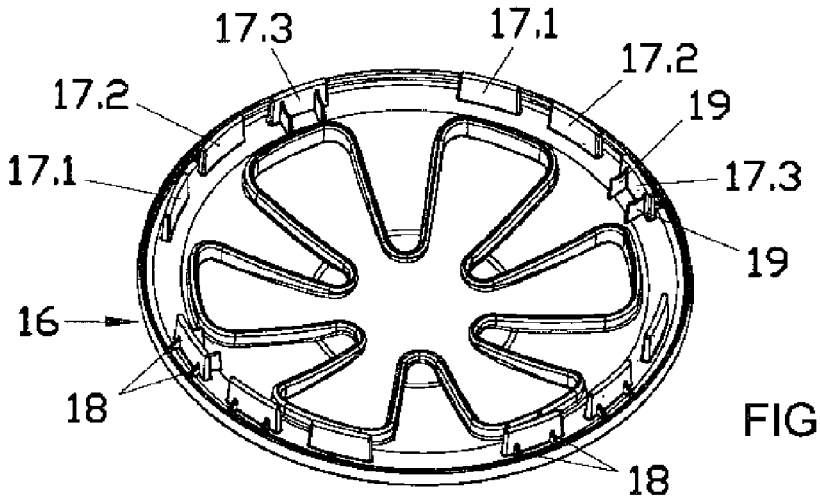
FIG. 10 shows a perspective view from the bottom of a single support disk that is part of the support element.
Figure 11:
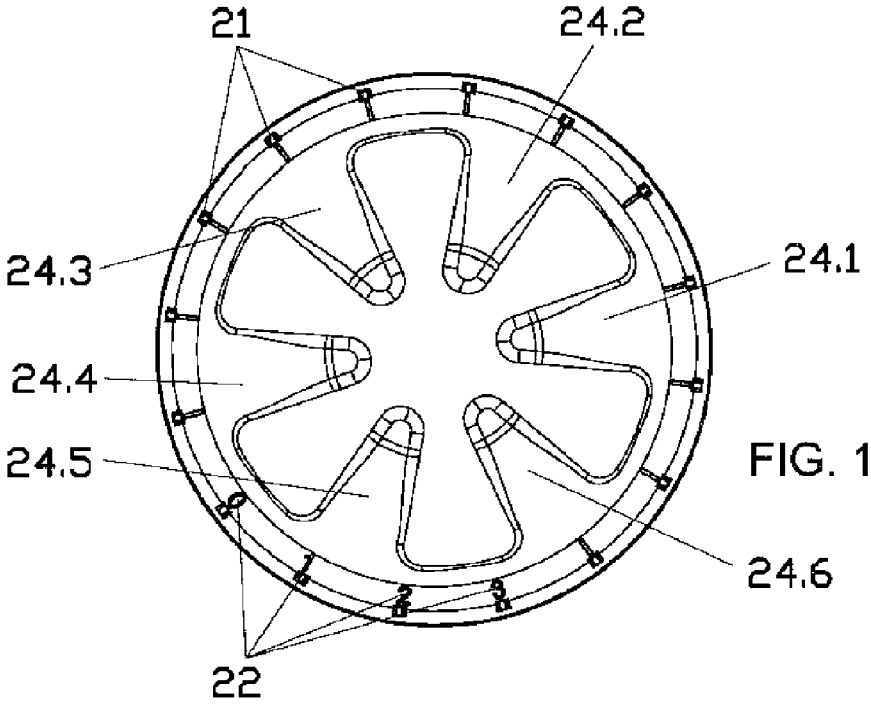
FIG. 11 shows a top view from the top onto the support disc of FIG. 10.

The frame part 15 has a substantially rectangular outer shape and comprises a center recess into which a support disc 16 is inserted. The support disc 16 is rotatable about the central axis 8 of the support element 1 and placed on retaining shoulders 23 that prevent the support disc 16 from falling through into the direction of the base plate 2. The retaining shoulders 23, as can especially be seen in FIGS. 7, 8, and 9, are disposed on both sides of the spring arms 6 with the corrugated spring elements 7 disposed thereon.

In the outer region of the support disc 16 a plurality of bars 17.1, 17.2, and preferably 17.3 are arranged concentrically on a mutual ring track with a bar-free area between the adjacent bars 17.3 and 17.1. The disposition of the bars 17.1, 17.2, and 17.3 can be taken from the bottom views of the support element according to FIGS. 3*a*, 4*a*, 5*a*, and 6*a*. The bars 17.1, 17.2, and 17.3 as well as the bar-free position next to the bar 17.1 or 17.3, respectively, are associated with a corrugated spring element 7 and form an assembly each so that there are a total of twelve bars in four groups on the ring track.

Due to the fact that the support disc 16 is rotatable within the frame part 15, it is possible to push one bar 17.1, 17.2, or 17.3 of an assembly into the U-shaped intermediate space of the two spring legs 11 and 12 of a corrugated spring element 7.

As can be seen in FIGS. 3*b* through 6*b*, the movement of spring legs 11 and 12 is limited to a different degree after a bar is pushed into the intermediate space of the spring legs 11 and 12 when weight is applied to the support element 1. The restriction or limitation of the movement of the spring legs 11 and 12 results in an increase in stiffness of the support element so that it is possible to set different degrees of spring hardness by rotating the support disc 16.

Figure 3:
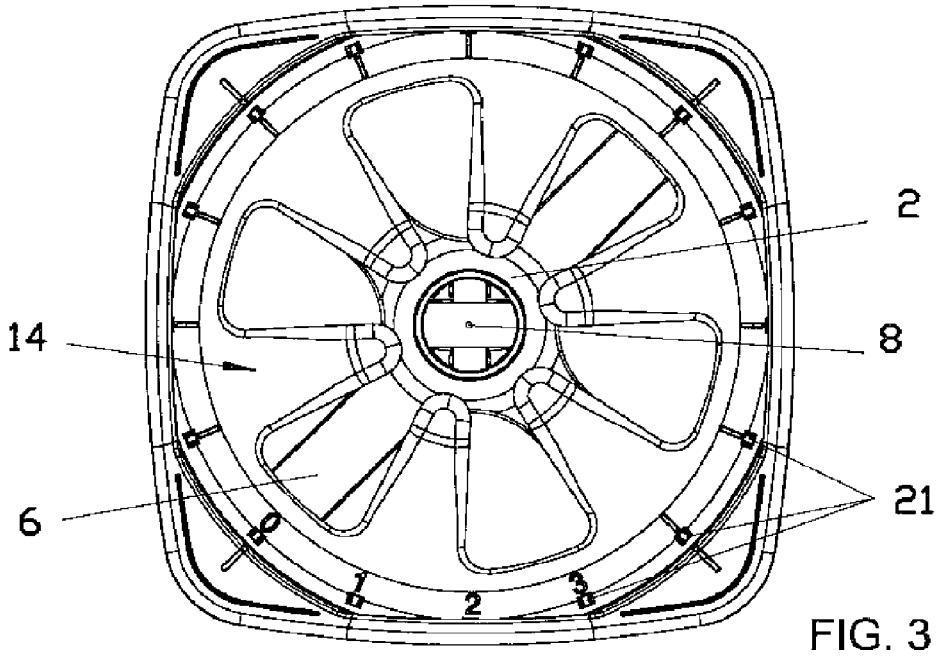
FIG. 3 shows a top view of the support element from FIG. 1 with spring stage 0 with the lowest spring stiffness being shown.
Figure 3A:
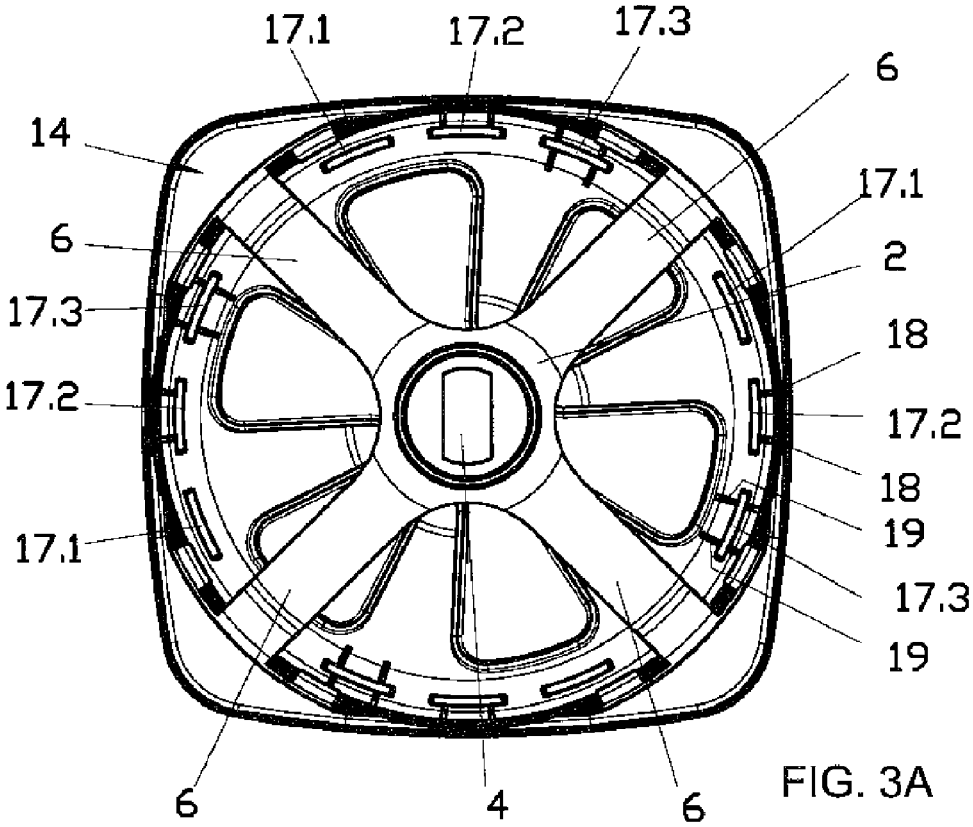
FIG. 3*a* shows a bottom view of the spring element from FIGS. 1 through 3 in stage 0 of the spring stiffness.
Figure 3B:
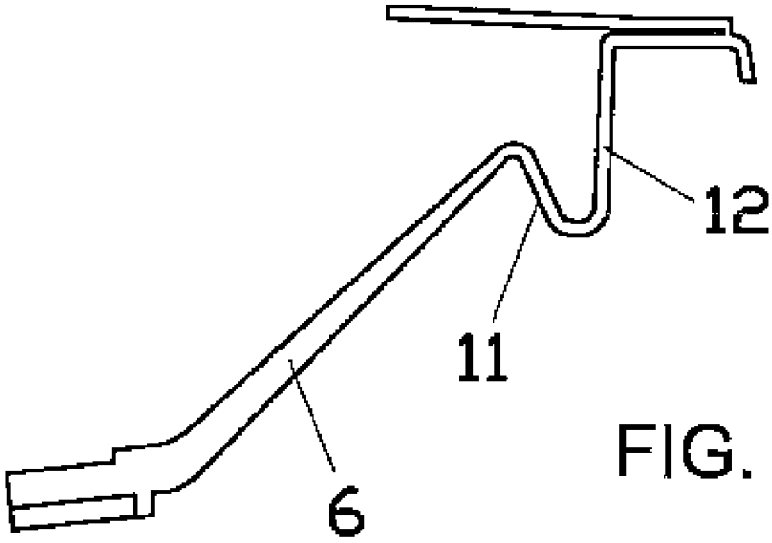
FIG. 3*b* shows a schematic partial view of the corrugated spring element that is part of the support element according to the invention in stage 0 of the spring stiffness.

Due to the number of bars 17.1, 17.2, and preferably 17.3 and taking the bar-free position into account, it is possible to set four different degrees of hardness of the springs of the support element around the circumference. FIG. 3 shows that the alphanumeric identification of stage 0 in the lower bottom corner of the support element in the drawing indicates the softest spring constant. The bottom view of the support element 1 in FIG. 3*a* shows that in this stage 0 none of the bars is pushed into the intermediate space between the spring legs 11 and 12 of a corrugated spring element 7. The spring legs 11 and 12 thus can carry out an unrestricted movement according to FIG. 3*b* and thus an unlimited spring effect.

Figure 4B:
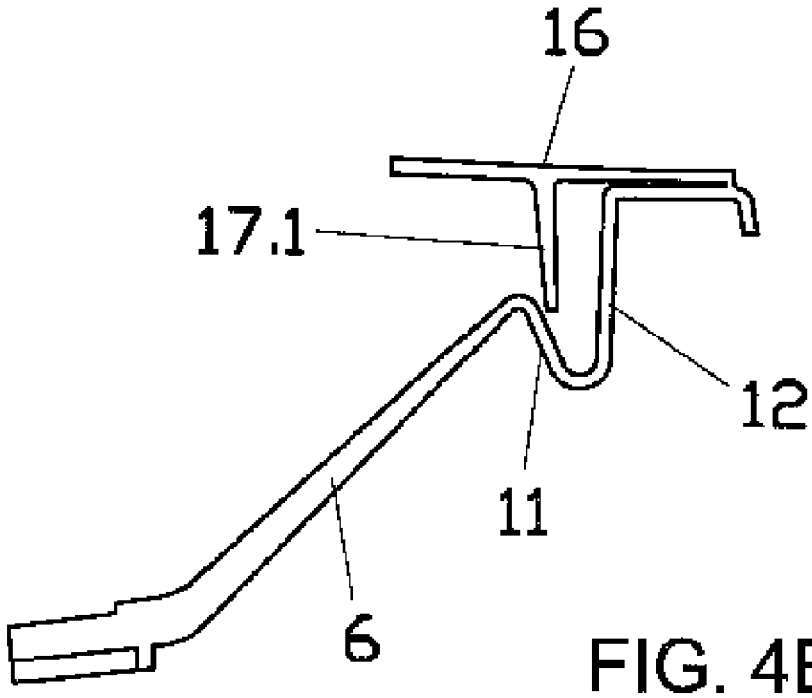
FIG. 4*b* shows a schematic partial view according to FIG. 3*b* of the corrugated spring element in stage 1 of spring stiffness.
Figure 4:
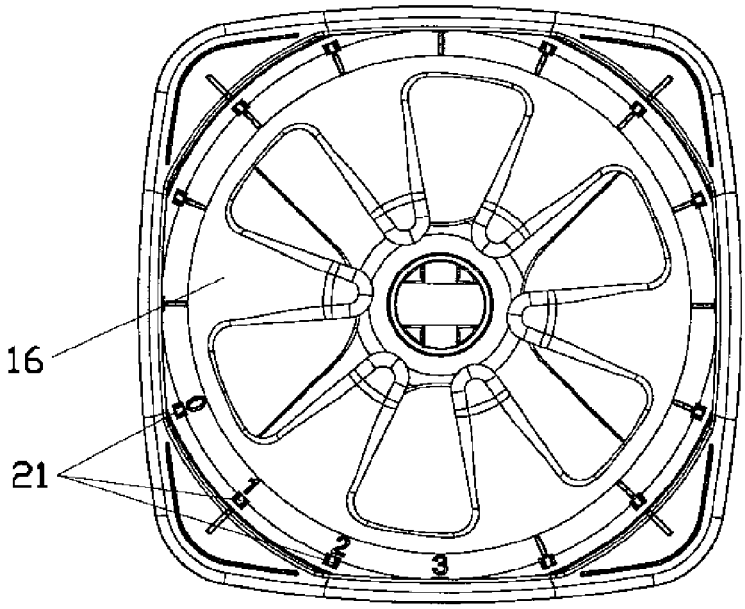
FIG. 4 shows a top view of the spring element according to the invention in stage 1 with somewhat higher spring stiffness.
Figure 4A:
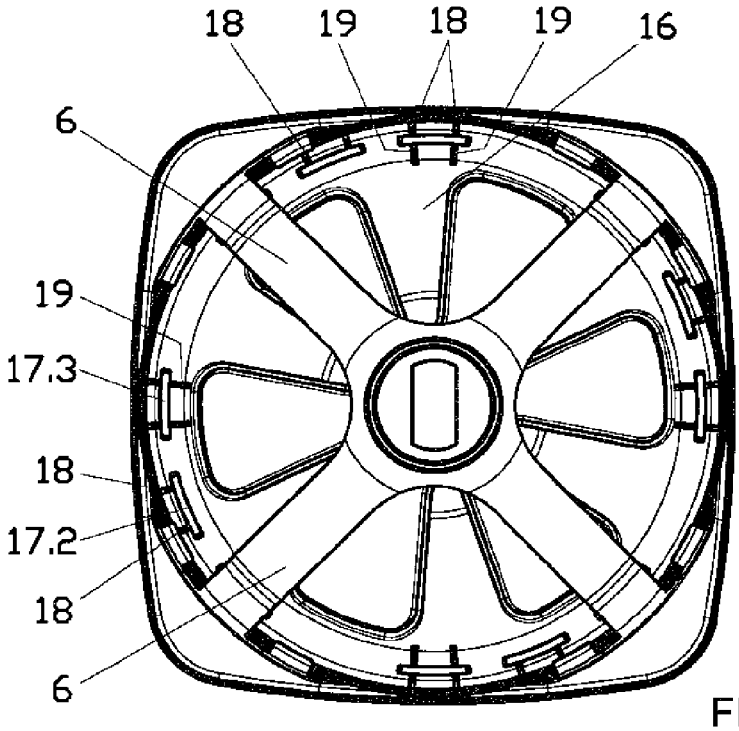
FIG. 4*a* shows a bottom view of the support element in stage 1 of spring stiffness.
Figure 5:
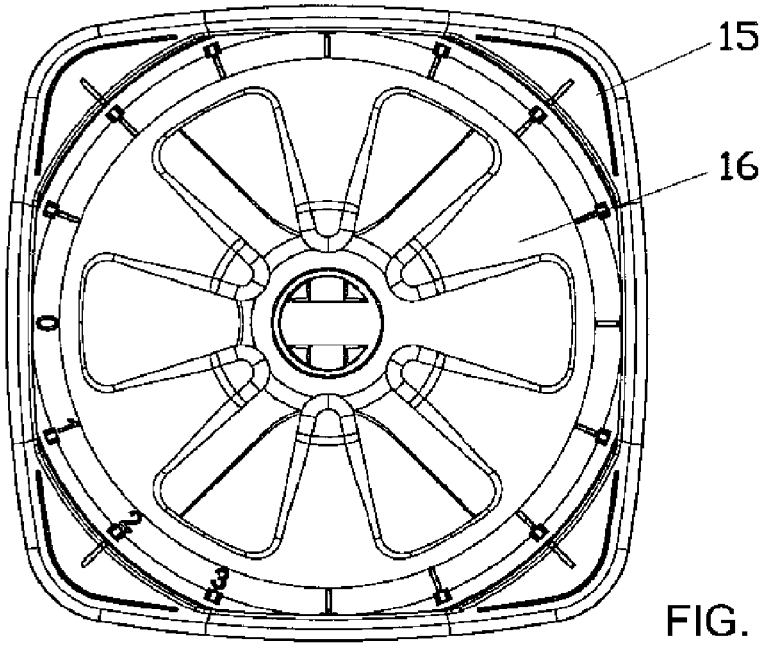
FIG. 5 shows a top view of the support element according to the invention in stage 2 of spring stiffness, an increase over stage 1.
Figure 5A:
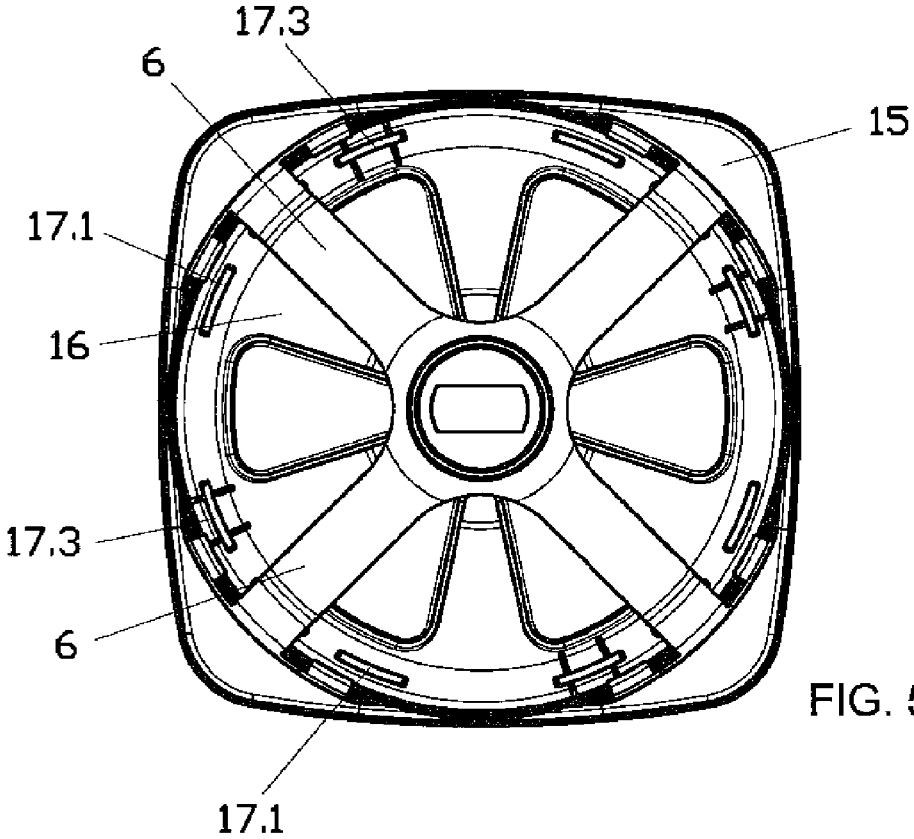
FIG. 5*a* shows a bottom view of the support element from FIG. 5.
Figure 5B:
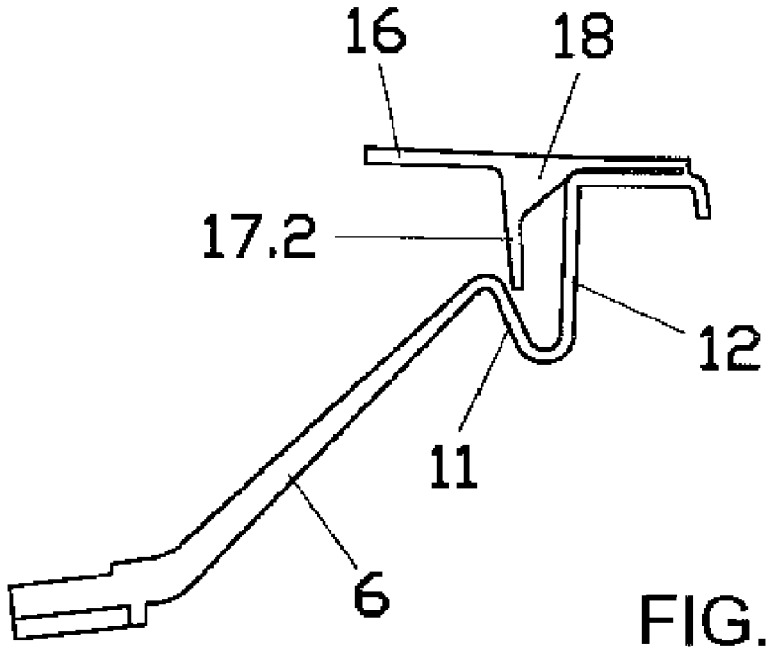
FIG. 5*b* shows a schematic partial view of the corrugated spring element in stage 2 of spring stiffness.
Figure 6B:
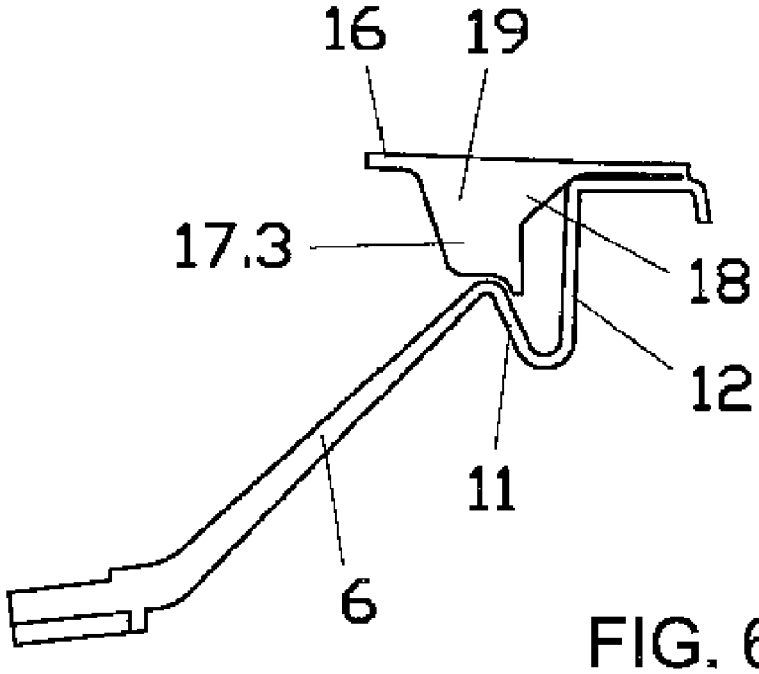
FIG. 6*b* shows a schematic partial view of the corrugated spring area of the support element in stage 3 with the highest degree of spring stiffness of the spring element.

FIG. 3*a* also shows that the bars 17.1, 17.2, and 17.3 have outer stiffening ribs 18 and inner stiffening ribs 19 along their perpendicular lateral faces. The number of stiffening ribs in this exemplary embodiment is two each on each of the bars 17.2 and 17.3 for the outer stiffening ribs 18 as well as for the inner stiffening ribs 19. FIG. 3*a* also shows that the bar 17.2 has two outer stiffening ribs 18 and bar 17.3 has outer stiffening ribs 18 as well as inner stiffening ribs 19. The design of the stiffening ribs varies, as is shown in the presentation of FIGS. 4*b*, 5*b*, and 6*b*. The stiffening ribs 18 and 19, in connection with the cross-section design in the shape of a rectangle of the bars 17.1, 17.2, and 17.3, must provide the bars with different degrees of yield.

This results in a higher degree of yield for bar 17.1 that only allows for a certain restriction of the movement of the corrugated spring element due to the design of its cross-section. The restriction of the movement of the spring legs 11 and 12 of a corrugated spring element 7 can be seen in FIG. 4*b*.

Figure 6:
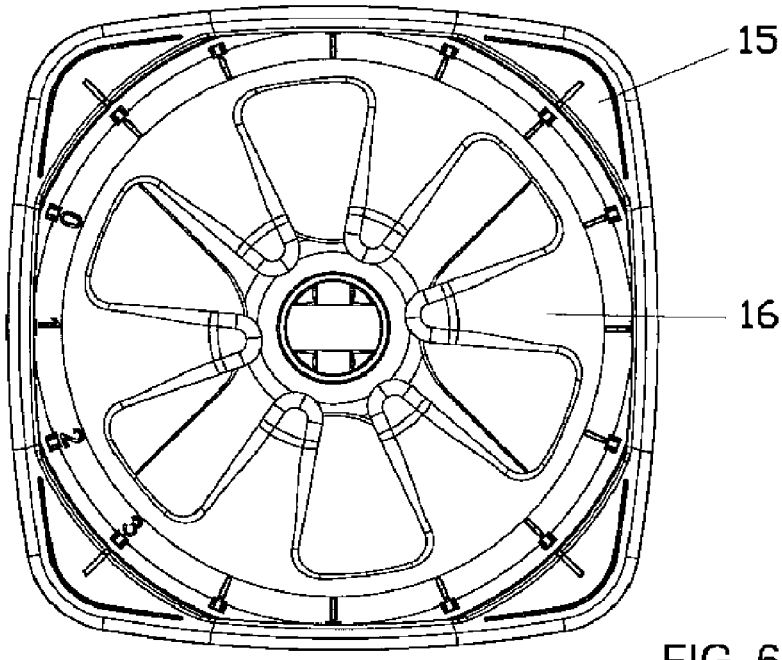
FIG. 6 shows a top view of the support element according to the invention in stage 3 with the highest degree of spring stiffness.
Figure 6A:
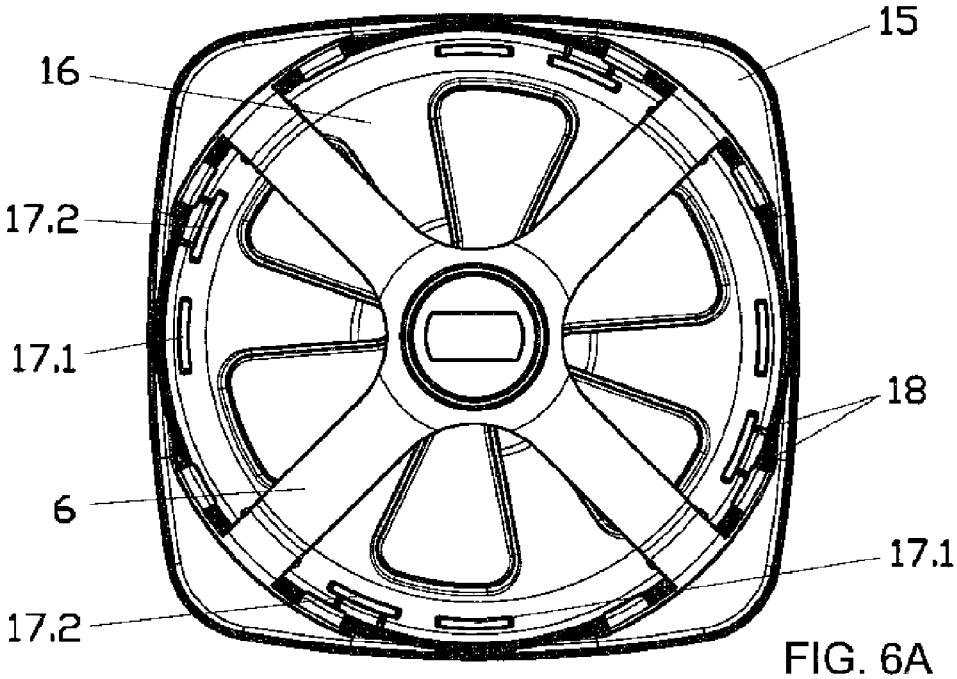
FIG. 6*a* shows a bottom view of the support element from FIG. 6.

The additional disposition of outer stiffening ribs 18 on bar 17.2 results in a higher degree of stiffness, which in turn is accompanied by a higher restriction of the movement of spring legs 11 and 12 according to FIG. 5*b*. FIGS. 5 and 5*a* show that on one hand the top view shows stage 2 as rotating position, which simultaneously causes bar 17.2 to be placed in the intermediate space between the spring legs 11 and 12 of the corrugated spring element 7. FIGS. 6 and 6*a* finally show the support element 1 according to the invention in stage 3, in which the bar 17.3, on which outer stiffening ribs 18 as well as inner stiffening ribs 19 are disposed, is placed in the intermediate space between the spring legs 11 and 12 by rotating the support disc 16.

As can additionally be seen in FIG. 6*b*, the embodiment of the bar 17.3 results in the movement of the spring legs 11 and 12 of the corrugated spring element 7 to be almost completely blocked. Thus stage 3 of the support element provides the highest degree of spring stiffness since now the spring deflection occurs only as a consequence of the elastic properties of the spring arms 6.

In order to fix the individual stages 0 to 3 of the spring stiffness of the support element 1, there is a snap-in locking device on the support disc 16 and the frame part 15 that is comprised of a plurality of latches 20 that are disposed in the middle between the spring arms 6 on the bottom of the frame part 15 oriented towards the base plate, which can especially be seen in FIG. 9. The latches 20 are functionally connected with latch recesses 21 disposed on the top of the support disc 16, into which the latches 20 engage and thus fix the respective spring stiffness stages 0 to 3. To easily check the respective stage setting, the support disc 16 furthermore has a display device 22, as already mentioned, that is comprised of alphanumeric characters.

Figure 13:
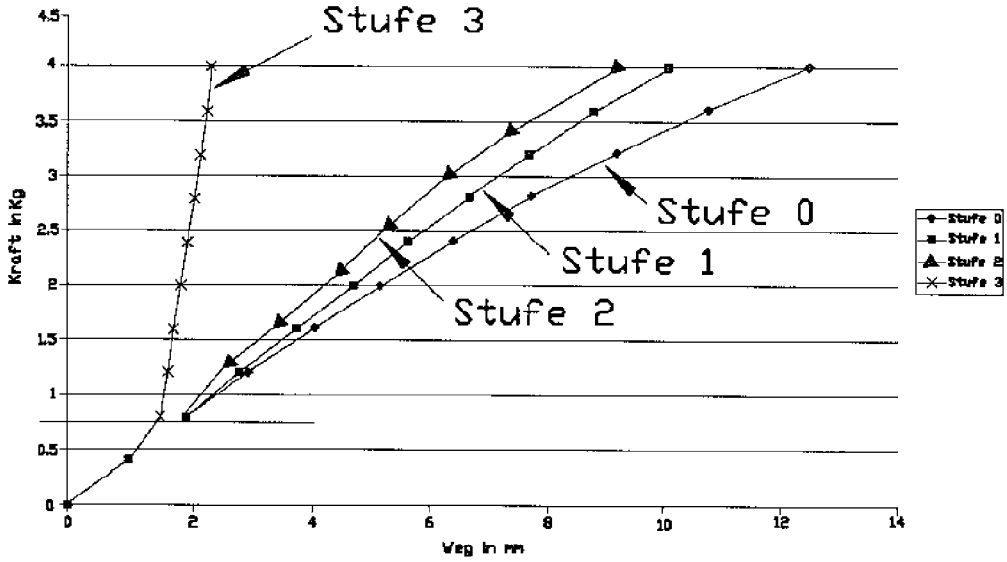
FIG. 13 shows a stiffness diagram of the support element according to the invention as a function of the forces acting on the support element for the different adjusting stages 0 through 3.

In order to clarify the different selectable degrees of spring stiffness of the support element according to the invention, FIG. 13 shows a path/force/stiffness diagram. This diagram clearly shows that in stage 0 there is a higher degree of yield in relation to the forces that act on the support element, i.e. there is a longer spring path of the support element. This spring path is restricted by approx. two millimeters in stage 1, provided the same force of four kilograms is applied for the deflection.

In stage 2 the spring stiffness is even higher so that there is an additional restriction of the spring path. Finally the diagram in FIG. 13 shows stage 3 in which the corrugated spring elements in principle are blocked due to the special design of the bars 17.3.

According to an advantageous further development of the support element according to the invention the support element can optimally be equipped with a so-called airlift function. The airlift function is integrated into the support disc 16 and substantially is comprised of the support disc 16 having a plurality of, in the present case, six support faces 24.1, 24.2, 24.3, 24.4, 24.5, and 24.6 that, in the present case, have a triangular design and whose one lateral region is fixed in the outer edge region of the support disc 16.

Figure 2:
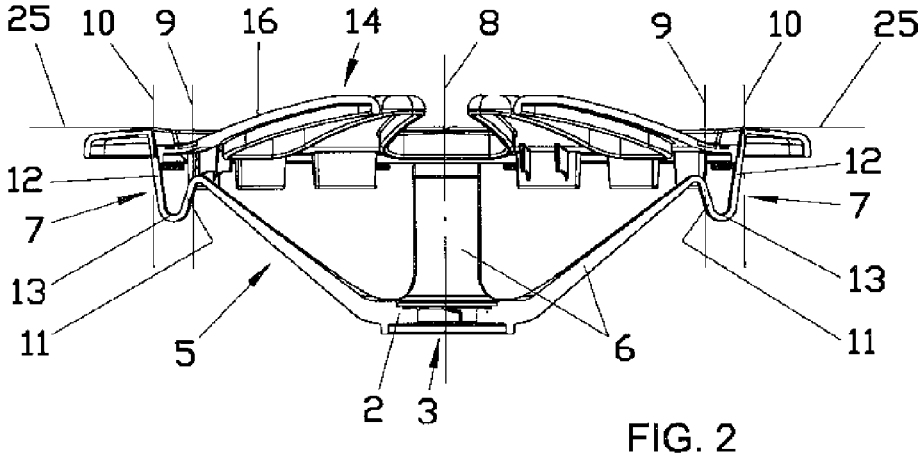
FIG. 2 shows a half section presentation of the support element from FIG. 1.
Figure 12:
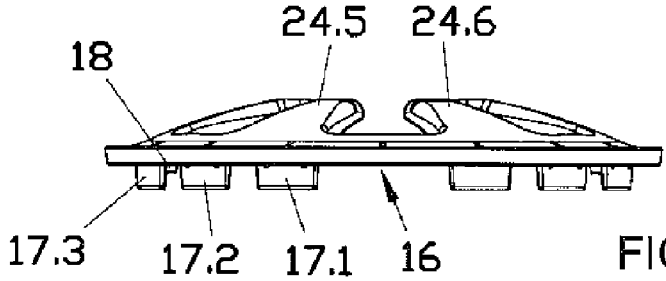
FIG. 12 shows a lateral view of the support disk of FIGS. 10 and 11.

As can especially be seen in FIG. 2 and FIG. 12, the edge region of the support faces 24.1 through 24.6 that are oriented towards the middle, slant upward over a support plane defined by the frame part 15.

The embodiment of the support faces 24.1 through 24.6 is such that when weight is applied to the support element with the cushion cover only lying on the support disc 16 in the form of a mattress, for example, the cushion cover only lies on the front edge regions of the support faces 24.1 through 24.6 oriented towards the central axis 8. This results in a point-shaped support so that there is better back ventilation of the cushion cover or the mattress, respectively, compared to customary support elements.

If more weight is applied to the support disc or the cushion cover, respectively, due to a person lying on it, the support faces that slant upwards together with the frame part form an overall uniform support plane 25 so that the cushion cover is supported contiguously.

The support faces, as can be seen in the top views of FIGS. 1, 3, 4, 5, and 6 are arranged symmetrically in relation to the central axis on the support disc 16 whereby the number of support faces 24.1 through 24.6 of course can be different than shown in the exemplary embodiment. Furthermore, the shape of the support faces 24.1 through 24.6 can be different as well. The angle of the support faces 24.1 through 24.6 in relation to the support plane 25 can range between 5 and 40 degrees according to an advantageous design. The selection of the angle depends on the elastic properties of the plastic material of the support disc 16 as well as on the weight of the cushion elements resting on the individual support elements.

REFERENCE LIST

1 support element
2 base plate
3 fastening device
4 opening
6 spring arm
7 corrugated spring element
8 central axis
9 ring track
10 ring track
11 spring leg
12 spring leg
13 connecting bar
14 support plate
15 frame part
16 support disc
17.1 bar
17.2 bar
17.3 bar
18 outer stiffening rib
19 inner stiffening rib
20 latch
21 latch recess
22 display device
23 retaining shoulder
24.1 support face
24.2 support face
24.3 support face
24.4 support face
24.5 support face
24.6 support face
25 support plane

The invention claimed is:

1. Support element for a cushion cover to be supported above the support element for seating and lying areas, comprising a base plate that can be fixed to a base, at least one spring element formed by a plurality of spring arms and extending upward from the base plate in a direction of the cushion cover, wherein the spring arms each are provided with a respective substantially U-shaped corrugated spring element on upper ends thereof, the upper ends of the spring arms being remote from the base plate, the corrugated spring element comprising at least two spaced spring legs located on concentric inner and outer ring tracks and disposed about a central axis of the support element and at least one connecting bar joining the spring legs, one end of an inner spring leg of the at least two spring legs being located on the inner ring track and being connected to a respective spring arm, and one end of an outer spring leg of the at least two spring legs being located on the outer ring track and being connected to a support plate provided for supporting the cushion cover, and a support body rotatable about the central axis of the support element for changing a degree of hardness of the support plate, wherein the support plate comprises a ring-shaped frame part connecting upper ends of at least some of the spring legs of the corrugated spring elements and a support disc rotatable about the central axis of the support element in the frame part, wherein the support disc is provided in an outer edge region of the support disc with an adjusting device for limiting movement of the spring legs and of the corrugated spring elements, the adjusting device comprises a plurality of bars arranged at regular intervals on a ring track arranged about the central axis of the support element on a lower flat side of the support disc facing the base plate, the plurality of bars making contact with a plurality of the spring legs and limiting the movement of the spring legs and of the corrugated spring elements when weight is applied to the support element, and a plurality of the plurality of bars arranged side by side on the ring track each are associated with a spring leg of the at least two spring legs and wherein the plurality of the plurality of bars have different degrees of stiffness.

2. Support element according to claim 1 wherein the plurality of bars have different cross-sections.

3. Support element according to claim 1 wherein the plurality of bars substantially have a rectangular cross-section.

4. Support element according to claim 1 wherein, for each spring arm, three bars of the plurality of bars are arranged side by side on the ring track and are associated with a respective corrugated spring element of a respective spring arm and are arranged to limit the movement of the spring legs and of the corrugated spring element of each spring arm in four stages when weight is applied to the support element, the four stages corresponding to an adjustment of a spring constant of the spring element to four different values.

5. Support element according to claim 1 wherein the support disc comprises a snap-in locking device for fixing the support disc in different positions in relation to the frame part.

6. Support element according to claim 5 wherein the snap-in locking device comprises at least one latch on the frame part or on the support disc that can be latched in a corresponding latch recess on the support disc or the frame part that also forms part of the snap-in locking device.

7. Support element according to claim 1 wherein the support disc comprises a display device for displaying the position of the support disc in relation to the frame part.

8. Support element according to claim 1 wherein at least one bar of the plurality of bars is connected with an inner spring leg of a corrugated spring element of at least one of the spring arms.

9. Support element according to claim 1 wherein a spring path of at least one corrugated spring element is blocked with at least one bar of the plurality of bars.

10. Support element according to claim 1 wherein the support disc comprises at least one support face that defines an acute angle in relation to the support plate.

11. Support element according to claim 10 wherein the at least one support face has a plate-shaped triangular outline, wherein one longitudinal side of the triangular outline is fixed to the support disc.

12. Support element according to claim 10 wherein the at least one support face comprises six symmetrically disposed support faces.

13. Support element according to claim 10 wherein the at least one support face are disposed in a protruding manner about the central axis of the support disc.

14. Support element according to claim 10 wherein the support element is made from plastic in an injection molding process.

15. Support element according to claim 10 wherein the angle of the at least one support face ranges between 5 to 40 degrees in relation to a plane perpendicular to the central axis of the support element.

16. Support element for a cushion cover to be supported above the support element for seating and lying areas, comprising a base plate that can be fixed to a base, at least one spring element formed by a plurality of spring arms and extending upward from the base plate in a direction of the cushion cover, wherein the spring arms each are provided with a respective substantially U-shaped corrugated spring element on upper ends thereof, the upper ends of the spring arms being remote from the base plate, the corrugated spring element comprising at least two spaced spring legs located on concentric inner and outer ring tracks and disposed about a central axis of the support element and at least one connecting bar joining the spring legs, one end of an inner spring leg of the at least two spring legs being located on the inner ring track and being connected to a respective spring arm, and one end of an outer spring leg of the at least two spring legs being located on the outer ring track and being connected to a support plate provided for supporting the cushion cover, and a support body rotatable about the central axis of the support element for changing a degree of hardness of the support plate, wherein the support plate comprises a ring-shaped frame part connecting upper ends of at least some of the spring legs of the corrugated spring elements and a support disc rotatable about the central axis of the support element in the frame part, wherein the support disc is provided in an outer edge region of the support disc with an adjusting device for limiting movement of the spring legs and of the corrugated spring elements, the adjusting device comprises a plurality of bars arranged at regular intervals on a ring track arranged about the central axis of the support element on a lower flat side of the support disc facing the base plate, the plurality of bars making contact with a plurality of the spring legs and limiting the movement of the spring legs and of the corrugated spring elements when weight is applied to the support element, and wherein the plurality of bars have lateral faces and at least one outer stiffening rib or an inner stiffening rib on at least one of the lateral faces, perpendicular to the ring track.

17. Support element according to claim 16 wherein a plurality of the plurality of bars arranged side by side on the ring track each are associated with a spring leg of the at least two spring legs and wherein the plurality of the plurality of bars have different degrees of stiffness.

18. Support element according to claim 16 wherein the at least one stiffening rib comprises at least two stiffening ribs, and both lateral faces have at least one stiffening rib disposed perpendicular to the ring track.

19. Support element according to claim 18 wherein the at least one stiffening rib on the two lateral faces of the plurality of bars comprises at least two stiffening ribs, the at least two stiffening ribs having different sizes.

20. Support element for a cushion cover to be supported above the support element for seating and lying areas, comprising a base plate that can be fixed to a base, at least one spring element formed by a plurality of spring arms and extending upward from the base plate in a direction of the cushion cover, wherein the spring arms each are provided with a respective substantially U-shaped corrugated spring element on upper ends thereof, the upper ends of the spring arms being remote from the base plate, the corrugated spring element comprising at least two spaced spring legs located on concentric inner and outer ring tracks and disposed about a central axis of the support element and at least one connecting bar joining the spring legs, one end of an inner spring leg of the at least two spring legs being located on the inner ring track and being connected to a respective spring arm, and one end of an outer spring leg of the at least two spring legs being located on the outer ring track and being connected to a support plate provided for supporting the cushion cover, and a support body rotatable about the central axis of the support element for changing a degree of hardness of the support plate, wherein the support plate comprises a ring-shaped frame part connecting upper ends of at least some of the spring legs of the corrugated spring elements and a support disc rotatable about the central axis of the support element in the frame part, wherein the support disc is provided in an outer edge region of the support disc with an adjusting device for limiting movement of the spring legs and of the corrugated spring elements, the adjusting device comprises a plurality of bars arranged at regular intervals on a ring track arranged about the central axis of the support element on a lower flat side of the support disc facing the base plate, the plurality of bars making contact with a plurality of the spring legs and limiting the movement of the spring legs and of the corrugated spring elements when weight is applied to the support element, the bars substantially have a rectangular cross-section, and wherein two stiffening ribs are disposed on lateral faces of the plurality of bars.

* * * * *